United States Patent [19]

Goldie et al.

[11] Patent Number: 4,749,550

[45] Date of Patent: Jun. 7, 1988

[54] METHOD OF INHIBITING CORROSION IN AQUEOUS SYSTEMS

[75] Inventors: Brian P. F. Goldie, Cheam; John J. McCarroll, Camberley, both of United Kingdom

[73] Assignee: The British Petroleum Company p.l.c., Middlesex, England

[21] Appl. No.: 946,177

[22] Filed: Dec. 23, 1986

Related U.S. Application Data

[63] Continuation of Ser. No. 649,286, Sep. 11, 1984, abandoned.

[30] Foreign Application Priority Data

Sep. 15, 1983 [GB] United Kingdom ..... 83/24717

[51] Int. Cl.[4] ..... C09D 5/08

[52] U.S. Cl. ..... 422/19; 252/389.1; 422/14

[58] Field of Search ..... 422/12, 13, 14, 19; 252/389.1

[56] References Cited

U.S. PATENT DOCUMENTS

| | | | |
|---|---|---|---|
| 2,913,419 | 11/1959 | Alexander . | |
| 3,223,620 | 12/1965 | Oberhofer | 422/19 |
| 3,527,703 | 9/1970 | Archer | 252/153 |
| 3,899,624 | 8/1975 | Sutherland | 428/327 |
| 4,054,723 | 10/1977 | Higginbotham et al. | 428/678 |
| 4,210,575 | 7/1980 | Drake | 260/42.52 |
| 4,405,493 | 9/1983 | Pippard | 252/389 A |
| 4,419,137 | 12/1983 | Cayless et al. | 106/14.39 |
| 4,495,225 | 1/1985 | Ciuba et al. | 252/395 |
| 4,532,045 | 7/1985 | Lettmann | 210/685 |

FOREIGN PATENT DOCUMENTS

| | | |
|---|---|---|
| 0046057 | 2/1982 | European Pat. Off. . |
| 1398047 | 6/1975 | United Kingdom . |
| 1459032 | 12/1976 | United Kingdom . |
| 1503153 | 3/1978 | United Kingdom . |
| 2097024 | 10/1982 | United Kingdom . |

OTHER PUBLICATIONS

Fischer, "Bildungsgeschwindigkeit Kathodisch erzeugter Hydroxid-Deckschichten", *Werks. Korro.*, 27, 231–236, 1976.

Banerjee, CA84 (24): 168392n, 1974.

Gerasyertina et al., CA86 (14): 97918s, 1977.

Hawley, ed., *The Condensed Chemical Dictionary*, 10th ed., Van Nostrand Reinhold Co. (New York), 1981, pp. 883–884.

*Primary Examiner*—Barry S. Richman
*Assistant Examiner*—W. R. Johnson
*Attorney, Agent, or Firm*—Morgan & Finnegan

[57] ABSTRACT

A method of inhibiting corrosion of a metal surface in an aqueous system comprising introducing corrosion inhibiting cations into the aqueous system. The corrosion inhibiting cations are selected from the group comprising cations of yttrium and cations of the metals of the lanthanum series which metals have atomic numbers from 57 to 71 inclusive. The cations may be introduced in the form of water soluble salts. Alternatively the cations may be releasably bound by ion exchange to a substrate and the ion-exchanged substrate introduced into the aqueous system.

12 Claims, No Drawings

METHOD OF INHIBITING CORROSION IN AQUEOUS SYSTEMS

This is a continuation of co-pending application Ser. No. 649,286, filed on Sept. 11, 1984 now abandoned.

This invention relates to a method of inhibiting corrosion of metal in aqueous systems.

It is known that certain cations, e.g. calcium and zinc cations, have corrosion inhibiting properties. However the applicants have found that certain other cations which have hitherto not been known to have corrosion inhibiting properties are particularly effective for inhibiting the corrosion of metal in aqueous systems.

Thus according to the present invention a method of inhibiting corrosion in an aqueous system comprising introducing corrosion inhibiting cations into the aqueous system is characterised in that the corrosion inhibiting cations are selected from the group comprising cations of yttrium and cations of the metals of the Lanthanum series which metals have atomic numbers from 57 to 71 inclusive. The preferred cations are yttrium, lanthanum, cerium and neodymium and mixtures of cations of the lanthanum series derived from natural ores.

The term "aqueous system" as used in this specification means a system in which a metal surface is intermittently or continuously in contact with water.

The corrosion inhibiting cations of yttrium or metals of the Lanthanum series may be introduced into the aqueous system in the form of soluble salts of the metals. Alternatively the cations may be releasably bound to a suitable substrate by ion-exchange and introduced into the aqueous system in that form.

Soluble salts of yttrium or metals of the Lanthanum series include nitrates, chlorides, bromides, iodides, acetates, sulphates and many complexes. Nitrates are particularly suitable for use in the present invention. The amount of soluble salt added to the aqueous system will be determined by the duty of the system. It has been found that effective corrosion inhibition can be obtained with a cation concentration of as low as 0.4 millimoles per liter. However, a preferred lower limit is one millimole per liter. Preferably the pH of the aqueous system is above 6.

The ion-exchange substrate may be any of the known ion-exchange materials such as zeolites or organic cation-exchange resins.

The cations may also be chemically bound by ion-exchange to particles of an inorganic oxide. The inorganic oxide is preferably silica and more preferably an activated silica. Other oxides which may be suitable include alumina, zirconia, iron oxide ($Fe_2O_3$ and $Fe_3O_4$) and tin oxide. Mixed metal oxides may also be suitable as may naturally occuring clays such as kaolinite.

It has been found that the protons of hydroxyl groups on the surface of inorganic oxides can be replaced directly or indirectly by the cations of yttrium or cations of the metals of the Lanthanum series by contacting the inorganic oxide with a solution containing the required cations. To carry out the ion-exchange the inorganic oxide may be contacted with an aqueous solution of a soluble salt (e.g. nitrate) of the required cation and the pH of the mixture adjusted as necessary, by the addition of a suitable, soluble, basic salt such as, for example alkali metal salts. A particularly suitable basic salt is sodium hydroxide. The preferential absorption of the required cation is assisted by the use of a relatively high concentration of the soluble salt of the required cation. Typically the concentration of the solution is about one mole. The pH of the mixture may be monitored by a suitable pH meter. The pH needs to be high enough to remove the protons but there is an upper limit determined by the pH level at which the competing reaction i.e. precipitation of the cation hydroxide or hydrous oxide, becomes significant. The minimum pH is determined by the affinity of the exchanging cation for the inorganic oxide. The maximum pH level is also dependent on the cation. Typically, the ion-exchange reaction will start to occur at a pH in the range 3.5 to 5.5 and the pH should not be allowed to rise above 7.

The ion-exchange reaction is an equilibrium reaction which can conveniently be carried out at ambient temperature (i.e. around 20° C.). However, temperatures greater than or less than ambient may be used. An increase in temperature reduces the time to reach equilibrium and a decrease in temperature increases the time to reach equilibrium. The concentration of the ions affects the position of the equilibrium. A high concentration of ions forces the reaction further to completion.

The uptake of ions can be followed by observing the fall of pH over a period of time following the addition of the base. When the pH no longer falls after the addition of the base then exchange is complete and the inorganic oxide can be milled, if necessary, washed and dried under vacuum. Uptake of cations in the oxide can be measured by XRF spectroscopy.

An alternative method of preparing the cation exchanged inorganic oxide particles comprises contacting an inorganic oxide having surface hydroxyl groups with an aqueous solution of an alkali metal salt at a pH sufficiently above 7 for the protons of the hydroxyl groups to be replaced by alkali metal cations and thereafter contacting the alkali metal exchanged inorganic oxide with a solution containing the required yttrium cations or cations of one or more metals of the lanthanum series so that the alkali metal cations are replaced by the required cations. The amount of alkali metal cations remaining in the final product will depend on the relative affinities of the exchanging ions for the oxide surface and also on the concentration of the solution containing the required cations. Typically the concentration of the solution is about one molar. This method has the advantage that the contamination of the product with the insoluble hydroxide of the required cations may be reduced. Sodium salts, such as sodium hydroxide are suitable alkali metal salts for use in this method.

Typically up to 0.5 millimoles/g of cation can be combined with the oxide. Since, as indicated above, the technique of ion-exchange is relatively simple, the selection of preferred inorganic oxides and the treatments to give maximum uptake of corrosion inhibiting cations can be determined by simple comparative experiments. The lower limit may be 0.01 millimoles/g but it is preferably 0.05 millimoles/g.

The inhibition of corrosion in an aqueous system by introducing into the aqueous system a substrate having the corrosion inhibiting cations releaseably bound to the surface of the substrate by ion exchange requires that the corrosion inhibiting cations are released into the aqueous system by ion-exchange with cations in the aqueous system. The rate at which the corrosion inhibiting cations are released from the substrate depends on the concentration of exchangeable cations in the aqueous system. Thus the corrosion inhibiting cations will be released relatively quickly from an aqueous system having a high cation concentration (i.e. a corroding or potentially highly corrosive system) whereas the cations will be released relatively slowly from an aqueous system having a low cation concentration.

The method according to the present invention is particularly suitable for aerobic aqueous systems such as, for example, water cooling systems, water-based cutting fluids and hydraulic fluids. However, it may also be useful for inhibiting corrosion in anaerobic aqueous systems eg central heating, anti freeze, drilling mud, or other down hole fluids used in drilling operations. The method may be used to inhibit the corrosion of ferrous metals and certain non-ferrous metals such as, for example, copper and aluminium, which metals are intermittently or continuously in contact with water.

The soluble salts or ion-exchanged substrates containing the corrosion inhibiting cations may be used in various ways according to the type of aqueous system. The soluble salts could, for example, be added to the aqueous medium in solid form or as a solution. The soluble salt could be added as a single treatment or could be continuously or intermittently added to the aqueous system to maintain the concentration of the corrosion inhibiting cations. The ion-exchanged particles could be dispersed in an aqueous medium or could be used as a fixed or fluidised bed.

The invention is illustrated by the following Examples.

EXAMPLE 1—LANTHANUM EXCHANGED SILICA

40g La $(NO_3)_3.6H_2O$ were added at ambient temperature to a slurry comprising 50 g of coarsely crushed silica sold by British Ceca Company Limited under the Trade Name "Cecagel Blanc" and 100 ml of distilled water. The pH of the slurry was initially 2.74 and fell to 2.19 on the addition of the $La(NO_3)_3.6H_2O$. A 4M solution of Na OH was added dropwise to the slurry and the pH monitored. The pH rose steadily to 5.5 and then a response typical of rapid ion-exchange was noted, i.e. the initial rise in pH due to the addition of the Na OH solution was followed by a steady fall in pH. The addition of the Na OH solution was continued until the precipitation of $La(OH)_3$ became significant. The mixture was stirred for a further 15 minutes. The final pH was 6.5.

The exchanged silica was separated from the supernatant solution by decantation and repeatedly washed with distilled water. The product was ground with water in a ball mill for about 14 hours and then filtered, washed by re-slurrying and re-filtering and finally dried under vacuum at 80° C. for about 14 hours. Disaggregation of the resulting dry cake in a laboratory mill yielded a white pigment, containing 1.4% wt/wt of La (0.1 m mol/g).

EXAMPLE 2—CERIUM EXCHANGED SILICA

To a stirred slurry of 150 g Cecagel Blanc in 300 ml distilled water at ambient temperature were added 125 g $Ce(NO_3)_3.6H_2O$. The pH fell from 2.64 to 1.89. A 10 M solution of NaOH was then added dropwise. A rapid exchange reaction began above pH 4. At pH 6.5 $Ce(OH)_3$ precipitate began to appear. Further NaOH was added to maintain the pH in the range 6–6.5 until the exchange slowed. The final slurry pH was 6.4.

The exchanged silica was separated and processed as described in Example 1, to yield a cream coloured pigment containing 2.6% w/w Ce (0.19 m mol $g^{-1}$).

EXAMPLE 3—YTTRIUM EXCHANGED SILICA

To a stirred slurry of 100 g Cecagel Blanc in 200 ml distilled water at ambient temperature were added 76.6 g $Y(NO_3)_3.6H_2O$. The pH fell from 2.23 to 1.75. A 5M solution of NaOH was then added dropwise. In the pH range 3.5–5 a rapid exchange response appeared, but above this the reaction slowed rapidly and at pH 6 the system was stable.

The exchanged silica was recovered and processed as described in Example 1. The resulting white pigment contained 1.0% w/w Y (0.11 m mol $g^{-1}$).

EXAMPLE 4—LANTHANUM EXCHANGED SILICA

A 6M solution of sodium hydroxide was slowly added to a stirred slurry of 100 g Cecagel Blanc in 200 ml distilled water at ambient temperature. The pH rose rapidly. A typical ion-exchange response was observed above pH 3 but the pH was maintained above 7 to obtain sufficient uptake of sodium ions. Approximately 150 ml of the sodium hydroxide solution were added over 3 hours giving a final stable pH of 8.97. The exchanged silica was recovered by filtration, washed with distilled water and dried under vacuum at 85° C. for about 16 hours. The resulting granular material contained 2% wt/wt Na (0.87 mmol/g).

150 g of the sodium exchanged silica was added to a solution of 86 g of $La(No_3)_3.\ 6H_2O$ in 200 ml of water and the mixture stirred for 30 minutes. The lanthanum exchanged silica was recovered by filtration, washed with water and then ground with water in a ball mill for about 16 hours. The product was filtered and washed and then dried under vacuum at 85° C. for about 16 hours. De-aggregation of the cake yielded particles which contained 4% wt/wt La (0.29 mmol/g).

EXAMPLE 5

40 g of a commercially available mixture of rare earth chlorides were added to 100 ml of distilled water and 0.5 ml of molar hydrochloric acid to give a clear solution. 90 g of the sodium exchanged silica as prepared in Example 4 were added to the solution of rare earth chlorides and the slurry stirred for 45 minutes. The exchanged silica particles were recovered and processed in the same manner as described in Example 4. Analysis of the resulting particles showed that they contained approximately 1.2% wt/wt La, 4.2% Ce, 0.9% Pr, 3.0% Nd, 0.8% Sm and traces of Y.

EXAMPLE 6

10 g of each of the cation exchanged inorganic particles prepared in Examples 1 to 3 were added to 1000 ml samples of a 3.5% wt/wt solution of Na Cl in distilled water. The solutions were continuously sparged with air to maintain oxygen saturation and to keep the particles in suspension. A weighed grit-blasted, de-greased mild steel coupon measuring about 100 mm×40 mm×2.5 mm and weighing approximately 90 g was immersed in each solution for one week. The coupons were then de-rusted with ammoniacal acetylacetone and re-weighed. The percentage weight loss of the coupon exposed to a salt solution containing corrosion inhibiting particles (X) and the percentage weight loss of a coupon exposed to a salt solution containing no corrosion inhibiting particles (Y) were used to calculate a value for the efficiency of the corrosion inhibiting particles using the formula;

$$\text{Corrosion Inhibition Efficiency} = \frac{(Y - X)}{Y} \times 100\%$$

The corrosion inhibition efficiency of each of the particles prepared in Examples 1 to 3 is given in Table 1.

TABLE 1

Corrosion Inhibition Efficiency of Cation-Exchanged Inorganic Oxide Particles

| Example | Cation | Corrosion Inhibition Efficiency |
|---|---|---|
| 1 | $La^{3+}$ | 98 |
| 2 | $Ce^{3+}$ | 97 |
| 3 | $Y^{3+}$ | 96 |

The results indicate that the particles have good corrosion inhibiting properties.

EXAMPLE 7

The cation exchanged inorganic particles prepared in Example 4 and 5 were subjected to a similar test to that described in Example 6 except that a 1.0% wt/wt solution of Na Cl in distilled water was used.

The lanthanum exchanged silica particles prepared according to Example 4 and the silica particles having a mixture of cations of yttrium and the lanthanum series of metals bound to the surface of the particles as prepared in Example 5 both had a corrosion inhibition efficiency of 96.

EXAMPLE 8

The corrosion inhibition efficiency of a number of cations was measured using a process similar to that described in Example 6. To 1000 ml of a 3.5% wt/wt solution of Na Cl in distilled water was added sufficient nitrate of the cation under test to give a concentration of the cation in the salt water of one millimole. The test solution was continuously sparged with air to maintain oxygen saturation. A mild steel coupon was placed in the test solution for one week and the corrosion inhibition efficiency calculated as described in Example 6. The results given in Table 2 show that the soluble salts of the cations have good corrosion inhibiting properties.

TABLE 2

Corrosion Inhibition Efficiency of Cations in Solution

| Cation | Corrosion Inhibition Efficiency |
|---|---|
| $Pr^{3+}$, $Nd^{3+}$, $Sm^{3+}$, $Gd^{3+}$, $Tb^{3+}$, $Dy^{3+}$, $Ho^{3+}$, $Er^{3+}$, $Yb^{3+}$, $Y^{3+}$ | 98–100 |
| $Ce^{3+}$ | 91 |
| $La^{3+}$ | 82 |
| $La^{3+}/Nd^{3+}$ (70:30) | 94 |

EXAMPLE 9

The corrosion inhibition efficiency of a mixture of cations was measured using a process similar to that described in Example 8. A commercially available mixture of rare earth nitrates was added to a 1.0% wt/wt solution of Na Cl is distilled water to give a concentration of 100 ppm. The test solution was continuously sparged with air to maintain oxygen saturation. A mild steel coupon was placed in the test solution for one week and the corrosion inhibition efficiency was calculated as described in Example 6.

The mixture of rare earth nitrates contained 25% wt/wt La, 5.3% wt/wt Ce, 3.2% wt/wt Pr, 9.6% wt/wt Nd, 0.6% Sm and traces of Y and was found to have a corrosion inhibition efficiency of 94%.

EXAMPLE 10

The corrosion inhibition efficiency of yttrium cations was measured using a method similar to that described in Example 8 except that aluminum or copper coupons were used in place of the mild steel coupons. The concentration of the yttrium nitrate was 5 millimoles and the test period was about 190 hours.

The pH of the solution at the start of the test period was adjusted to 7 and at the end of the test the pH was 6.4 for the solution containing the aluminium panel and 6.5 for the solution containing the copper panel.

The corrosion inhibition efficiency of the yttrium cations with copper was 87 and with aluminium was 78. These results indicate that the yttrium cations can also inhibit corrosion of non-ferrous metals.

EXAMPLE 11

Potentiodynamic polarisation was used to measure the corrosion inhibition efficiency of a number of soluble salts of yttrium or a metal of the lanthanum series and also three samples of silica containing lanthanum, cerium or yttrium cations bound to the silica by ion exchange. The potentiodynamic polarisation techniques used followed the ASTM standards G3–74 and G5–78.

The test electrolyte used for each measurement was a 3.5% by weight solution of sodium chloride in distilled water. The electrolyte was at ambient temperature (about 22° C.) and was continuously stirred and aerated.

The soluble salts were all nitrates and were tested at a concentration of one millimole. The cation exchanged silica particles were tested at a level of 10 g per liter.

The test electrodes used were mild steel cyclinders measuring 3.8 cm long×0.6 cm in diameter. The mild steel had a nominal composition of 0.16–0.24% carbon, 0.5–0.9% manganese and the rest iron. Prior to each test run, the test electrode was degreased in an acetone/toluene mixture, wet polished to 320 grit and then washed with distilled water followed by acetone.

A standard one-liter, glass electrochemical test cell was used, with the test electrode centrally mounted in a separate side arm and connected to the bulk electrolyte via a porous glass window. The potential of the test electrode was measured with respect to a standard calomel reference electrode with ionic contact to the bulk electrolyte via a salt bridge incorporating a Luggin probe.

The basis of the potentiodynamic polarisation technique is to produce measured polarisation curves through potential control of the test electrode with respect to a reference electrode. A potentiostat was used to control the test electrode potential to a preselected potential - time programme fed from a voltage scan generator. The test electrode potential was changed at a scan rate of 20 mV/min and the test electrode potential and logarithm of the cell current recorded continuously on an X-Y recorder.

The corrosion rates of the test electrodes in the 3.5% wt sodium chloride solutions containing the soluble salts or cation exchanged silica particles (X) were determined by both Tafel extrapolation and by Stern-Geary extraction. The corrosion rate of a test electrode in a 3.5% wt sodium chloride solution without a corrosion inhibitor (Y) was also determined by each of these methods. The results were used to calculate corrosion inhibition efficiencies using the formula given in Example 6. The corrosion inhibition efficiencies obtained by the two methods as well as the average of the two results are given in Table 3. The results indicate that the soluble salts and the cation exchanged silica particles have good corrosion inhibiting properties.

TABLE 3

Corrosion Inhibition Efficiencies Determined by Potentiodynamic Polarisation

| Corrosion Inhibitor | Percentage Corrosion Inhibition Efficiency | | |
|---|---|---|---|
| | Tafel Extrapolation | Stern-Geary Extraction | Average |
| $Y(NO_3)_3.6H_2O$ | 96 | 98 | 97 |
| $La(NO_3)_3.6H_2O$ | 72 | 76 | 74 |
| $Ce(NO_3)_3.6H_2O$ | 78 | 83 | 80.5 |
| $Pr(NO_3)_3.5H_2O$ | 82 | 83 | 82.5 |
| $Dy(NO_3)_3.5H_2O$ | 98 | 93 | 95.5 |
| $Yb(NO_3)_3.5H_2O$ | 88 | 93 | 90.5 |
| La/Silica | 98 | 95 | 96.5 |
| Ce/Silica | 42 | 60 | 51 |
| Y/Silica | 98 | 98 | 98 |

We claim:

1. A method of inhibiting corrosion of a metal surface in contact with an aqueous system comprising introducing into the aqueous system, cations selected from the group consisting of cations of yttrium and cations of the metals of the lanthanide series, said cations being introduced in the form of material capable of releasing said cations into the aqueous system to produce a solution of said cations wherein the material is selected from the group consisting of nitrate, chloride, bromide, iodide, acetate and sulphate salts of said cations and cation-exchanged substrates including said cations and said metal surface being in contact with said solution for a period of at least 7 days.

2. A method as claimed in claim 1 in which the aqueous system is an aerobic system.

3. A method as claimed in claim 1 in which the metal surface is a member of the group consisting of ferrous metal, copper and aluminium which is intermittently or continuously in contact with said solution.

4. A method as claimed in claim 1 in which the concentration in solution of the corrosion inhibiting cations is at least 0.4 millimoles per liter.

5. A method as claimed in claim 1 in which the concentration in solution of the corrosion inhibiting cations is at least 0.1 millimoles per liter.

6. A method as claimed in claim 1 in which the corrosion inhibiting cations are releasably bound by ion-exchange to a substrate and the cation-exchanged substrate is contacted with the aqueous system.

7. A method as claimed in claim 6 in which the cation-exchanged substrate is contacted with a portion of the aqueous system which is passed through a fixed or fluidized bed comprising the ion-exchanged substrate.

8. A method as claimed in claim 6 in which the cation-exchanged substrate is a zeolite.

9. A method as claimed in claim 6 in which the cation-exchanged substrate is an organic cation-exchange resin.

10. A method as claimed in claim 6 in which the substrate is formed of particles of an inorganic oxide.

11. A method as claimed in claim 10 in which the inorganic oxide is selected from the group comprising silica, alumina, zirconia, iron oxide, tin oxide mixed metal oxides and kaolinite.

12. A method as claimed in claim 10 in which the inorganic oxide is activated silica.

* * * * *